United States Patent [19]

Simard

[11] Patent Number: 4,896,781

[45] Date of Patent: Jan. 30, 1990

[54] TWIST-TO-REMOVE CROWN CAP WITH A FINGER PROTECTIVE GRIPPING SURFACE

[76] Inventor: Laval Simard, 893 des Rochers, St-Félicien, Quebec, Canada, G8K 1N6

[21] Appl. No.: 249,458

[22] Filed: Sep. 23, 1988

[51] Int. Cl.[4] ..... B65D 41/04

[52] U.S. Cl. ..... 215/328

[58] Field of Search ..... 215/295, 305, 302, 324, 215/326, 328

[56] References Cited

U.S. PATENT DOCUMENTS

| | | | |
|---|---|---|---|
| 1,774,727 | 9/1930 | Roehm | 215/326 |
| 1,845,421 | 2/1932 | Klist | 215/326 |
| 1,882,359 | 5/1930 | Greenhouse . | |
| 2,198,117 | 4/1940 | Kancer . | |
| 2,361,507 | 10/1944 | Sonnenberg | 215/326 |
| 2,390,291 | 12/1945 | Blackman . | |
| 3,232,469 | 2/1966 | Piazze . | |
| 3,253,729 | 5/1966 | Virany . | |
| 3,272,267 | 9/1966 | Long . | |
| 3,514,004 | 5/1970 | Hammersmith | 215/328 |
| 4,627,548 | 12/1986 | Thompson | 215/295 |
| 4,702,383 | 10/1987 | Wender | 215/232 |

FOREIGN PATENT DOCUMENTS

| | | | |
|---|---|---|---|
| 719945 | 10/1965 | Canada . | |
| 2753239 | 6/1979 | Fed. Rep. of Germany . | |
| 259040 | 10/1926 | United Kingdom . | |
| 1036399 | 7/1966 | United Kingdom | 215/305 |

*Primary Examiner*—Donald F. Norton

*Attorney, Agent, or Firm*—Helfgott & Karas

[57] ABSTRACT

The present invention relates to a twist-to-remote crown cap for closing a container such as a beer bottle. The crown cap comprises a disk shaped top wall and a depending lateral skirt with long serrations bent against the skirt in a circumferential direction thereof to expose, each, a relatively flat flank surface. The flank surfaces of the serrations define a relatively smooth finger gripping surface preventing injury to fingers during the removal of the cap.

5 Claims, 1 Drawing Sheet

TWIST-TO-REMOVE CROWN CAP WITH A FINGER PROTECTIVE GRIPPING SURFACE

FIELD OF THE INVENTION

The present invention relates to the general field of bottle capsuling and more particularly, to an improved twist-off crown cap constructed to reduce the risk of injury to fingers during the removal operation of the cap.

Bottles containing beer or other beverages are normally closed by means of metallic cap, the so called crown cap which is directly formed on the neck of the bottle. The capsuling operation consists in mounting on the neck of the bottle a cap blank comprising a lateral skirt whose diameter exceeds the diameter of the neck and crimping the lateral skirt in locking engagement with the neck.

To facilitate the removal of the crown cap, it has been suggested to threadedly engage the cap on the neck of a bottle, allowing to remove the cap simply by twisting it off the bottle.

Although such twist-off caps have numerous advantages, they have a serious drawback in that the sharp serrations on the lateral skirt may cause injuries to fingers during the removal operation of the cap. One solution to the problem is to provide a cushioning member on the cap which will prevent direct contact between the fingers and the serrations, however this solution requires additional steps during the bottle capsuling process which increases manufacturing costs.

Thus, an object of the present invention is an improved twist-to-remove crown cap of inexpensive construction hence that reduces the risk of injury to fingers during the removal operation of the cap.

The crown cap, according to the invention, comprises a top wall from which extends downwardly a lateral skirt. On the lateral skirt are formed serrations reducing the diameter of the skirt, to secure the cap in sealing relation with the neck, the serrations being more spaced out than in the case of a conventional cap. This arrangement has the effect of providing longer serrations which can be folded against the skirt of the cap in a circumferential direction thereof, so that the flat flank surfaces of the serrations are exposed constituting a relatively smooth finger gripping surface.

In a preferred embodiment of the invention, the serrations are folded against the skirt in the unscrewing direction of the cap so that if the fingers slip on the lateral skirt, they will meet firstly the trailing edges of the serrations which are constituted by the smooth bends uniting the serrations to the lateral skirt, and then the fingers will pass over the sharp leading edges of the serrations. This feature further contributes to reduce the risk of injury when removing the cap.

Advantageously, the trailing edges of the serrations project away from the lateral skirt more than the leading edges thereof which is due in large part to the presence of a bend at each trailing edge. This structure produces a slightly undulated finger gripping surface reducing slippage and yet being sufficiently smooth to prevent injuries.

DESCRIPTION OF A PREFERRED EMBODIMENT

Figure 1:
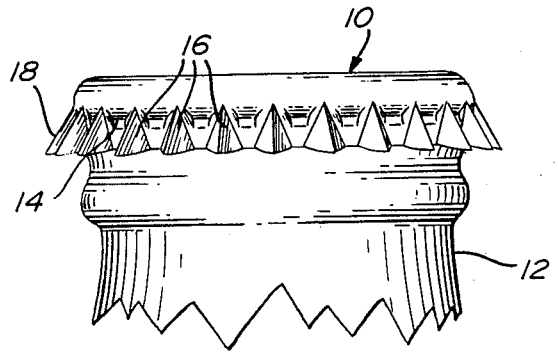
FIG. 1 is an elevational view of the crown cap according to the invention at an intermediate step of the forming process of the cap on the neck of a bottle.

Referring now to the annexed drawings, and more particularly to FIG. 1, the reference numeral 10 designates a twist-to-remove crown cap, according to the invention, at an intermediate step of the forming process, which has undergone operations to produce a lateral wall 14 crimped at equidistant intervals providing long radially projecting serrations 16 so as to reduce the diameter of the lateral skirt 14 to tightly engage the crown cap 10 on a neck 12 of a bottle.

Comparatively to a conventional crown cap, the serrations 16 are more spaced out in order to make them longer, each serration having a triangular shape with a sharp leading edge 18.

Figure 2:
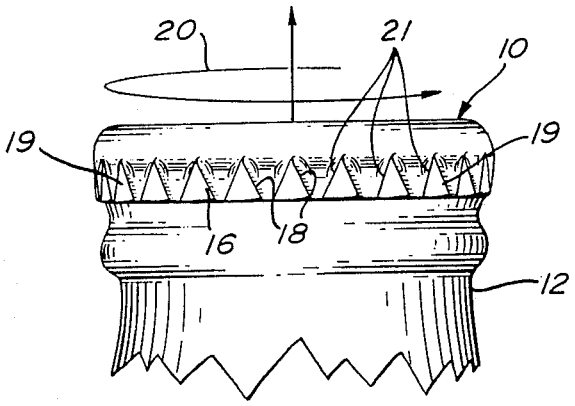
FIG. 2 is an elevational view of the crown cap at the end of the forming process.

To complete the forming of the crown cap 10, the serrations 16 are bent against the lateral skirt 14, in a circumferential direction thereof, as best shown in FIG. 2, to expose each, a flat flank surface. The flank surfaces of the serrations constitute a circumferentially extending finger gripping surface completely encircling the cap and which is sufficiently smooth to prevent injury to fingers when removing the cap.

Although non-illustrated in the drawings, the neck 12 of the bottle is provided with a screw thread on which the cap 10 is engaged.

Advantageously, the serrations 16 are bent in the unscrewing direction of the crown cap, which is identified in FIG. 2 by the arrow 20. Stated otherwise, the sharp leading edge 18 of each serration 16 follows the smooth trailing edge 21 thereof which is constituted by the bend uniting the serration to the lateral skirt, considered in the direction 20. Thus, if the fingers slightly slip on the crown cap 10, the fingers will firstly meet the smooth trailing edge 21 and then move over and away from the sharp leading edge 18.

The flank surfaces of the serrations 16 constitute a finger gripping surface, which is slightly undulated resulting from the fact that the trailing edge 21 of each serration 16 projects radially from the lateral skirt 14 more than the leading edge 18, which is due to the presence of a bend at the trailing edge. This undulated structure prevents slippage, yet it is relatively smooth to prevent injuries.

The above description of the preferred embodiment is given only as an example of the invention and it should not be interpreted in a limiting manner because many variations and refinements of this preferred embodiment may be envisaged. The scope of the invention is defined in the annexed claims.

I claim:

1. A twist-to-remove crown cap for closing a container having a threaded neck, the crown cap comprising a top wall; a depending skirt, said skirt comprising a plurality of each of said serrations extending in a substantially circumferential direction of said crown cap and including a relatively flat flank surface, the flank surfaces of the serrations constituting a relatively smooth finger gripping surface for the removal of said crown cap; and thread means adapted for engagement with the threaded neck of the container.

2. A crown cap as defined in claim 1, wherein each serration comprises trailing edge united to said skirt and a free leading edge, said trailing edge projecting from said skirt more than said leading edge constituting a slightly undulated finger gripping surface to prevent slippage.

3. In a combination of a container with a crown cap for closing a threaded neck of the container, the crown cap comprising a top wall; a depending skirt including a plurality of circumferentially extending serrations each exposing a relatively flat flank surface, the flank surfaces of the serrations constituting a relatively smooth finger gripping surface for the removal of said crown cap; and thread means adapted for engagement with the threaded neck of the container, wherein said serrations extend in a direction of unscrewing of said crown cap from the container.

4. A twist-to-remove crown cap for closing a threaded neck of a container, the crown cap comprising a top wall; a depending skirt including a plurality of serrations each including a relatively flat side flank surface and being bent against a surface of said skirt in a substantially circumferential direction of the cap to expose said side flank surface; and thread means adapted for engagement with the threaded neck of the container.

5. A twist-to-remove crown cap for closing a threaded neck of a container such as a bottle, said crown cap comprising a top wall and a depending skirt, said skirt comprising a plurality of serrations, each of said serrations including a relatively flat flank surface extending in a generally circumferential direction with respect to said crown cap, the flank surfaces of the serrations constituting a relatively smooth finger gripping surface for the removal of said crown cap, said crown cap further comprising thread means for engagement with said threaded neck.

* * * * *